United States Patent [19]

Mozley

[11] Patent Number: 4,804,357

[45] Date of Patent: Feb. 14, 1989

[54] MINERALS SEPARATOR

[75] Inventor: Richard H. Mozley, Falmouth, England

[73] Assignee: National Research Development Corporation, London, England

[21] Appl. No.: 51,649

[22] Filed: May 20, 1987

[30] Foreign Application Priority Data

May 22, 1986 [GB] United Kingdom ..... 8612497

[51] Int. Cl.[4] ..... B04B 11/00; B04B 5/32

[52] U.S. Cl. ..... 494/23; 209/434; 209/435; 209/445; 494/37; 494/47

[58] Field of Search ..... 209/422, 434–436, 209/438, 439, 444, 445, 451–453; 494/23, 27, 29, 37, 47, 52, 55, 85, 56

[56] References Cited

U.S. PATENT DOCUMENTS

| | | | |
|---|---|---|---|
| 499,344 | 6/1893 | Peck | 494/47 X |
| 881,013 | 3/1908 | Manley | 494/47 |
| 1,080,053 | 12/1913 | Finlay | 494/47 X |
| 1,985,514 | 12/1934 | McCleery | 209/452 X |
| 2,837,272 | 6/1958 | Laguilharre | 494/27 |
| 2,988,339 | 6/1961 | Mevissen | 209/434 X |
| 3,161,581 | 12/1964 | Tiedje et al. | 494/37 X |
| 4,608,040 | 8/1986 | Knelson . | |

FOREIGN PATENT DOCUMENTS

| | | | |
|---|---|---|---|
| 0140709 | 2/1950 | Australia | 209/445 |
| 80202 | 8/1982 | Australia . | |
| 1026693 | 3/1958 | Fed. Rep. of Germany . | |
| 1252022 | 12/1960 | France . | |
| 0528121 | 12/1976 | U.S.S.R. | 209/434 |
| 0564007 | 8/1977 | U.S.S.R. | 209/434 |
| 1210892 | 2/1986 | U.S.S.R. | 494/47 |
| 1215716 | 12/1970 | United Kingdom . | |
| 1576469 | 10/1980 | United Kingdom . | |

*Primary Examiner*—Johnny D. Cherry
*Assistant Examiner*—Edward M. Wacyra
*Attorney, Agent, or Firm*—Cushman, Darby & Cushman

[57] ABSTRACT

To separate minerals, they are mde up into a slurry applied through feed pipe 46 to a vertical-axis spiralinder 32 spinning on its axis to generate 10 g centrifugal force. The spiralinder is also subjected to axial vibration at 5 to 10 Hz. A film of slurry is held centrifugally to the internal surface of the spiralinder and kept in suspension by the vibration. The denser (i.e. higher specific gravity) particles in the slurry tend to be most firmly pinned centrifugally. The lightest particles thus drop first into the trough 44 and are dumped by switchable box 45. The centrifugal spinning is then slowed and the dense particles scoured off by wash water. The whole cycle is then repeated.

6 Claims, 2 Drawing Sheets

MINERALS SEPARATOR

Figure 1:
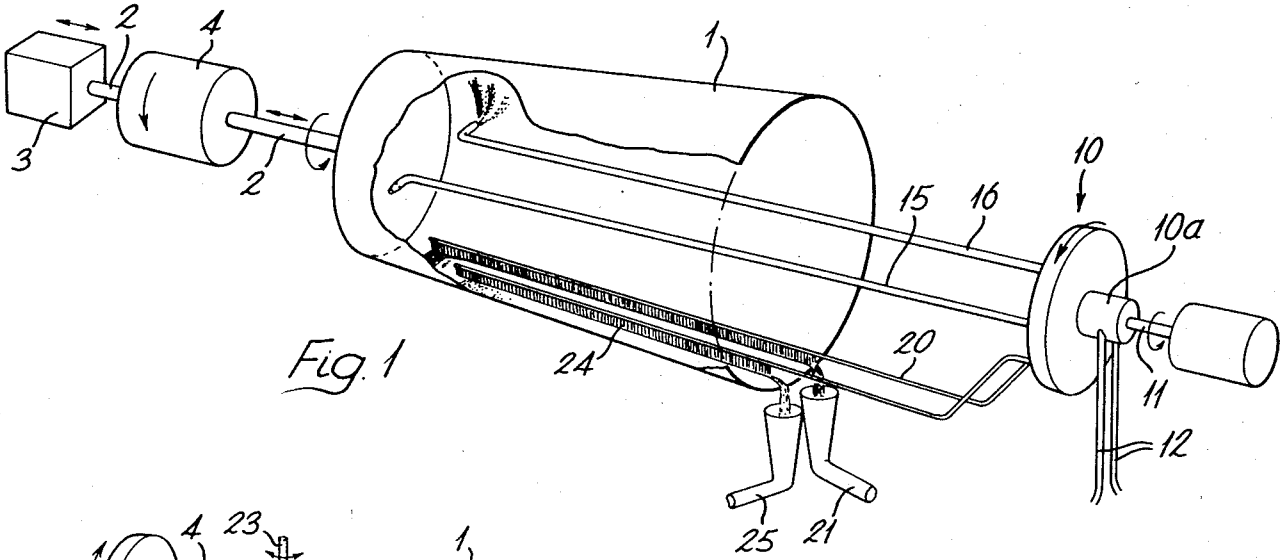

This invention relates to a minerals separator.

Minerals are conventionally separated on a shaking table. A slurry consisting of powdered minerals in water is supplied as a thin fluid film to part of the top edge of a gently sloping riffled table, which is shaken (with asymmetric acceleration) parallel to the top edge. Simultaneously, a film of washing water is applied to the rest of the top edge. The denser particles in the film move downhill more slowly than the lighter particles, but are shaken sideways faster than the lighter particles, and hence may be collected separately.

According to the present invention, a minerals separator comprises a body having a surface having the form of the inside of a cylinder which may be tapered (or of that figure which bears the same relationship to a cylinder as a spiral does to a circle, hereinafter a spiralinder) arranged when rotating about its axis to have a force acting axially along it, means for rotating the body about the axis of the cylinder to apply a centrifugal force exceeding g to said surface, means for applying perturbations to the body, means for intermittently applying a slurry and means for intermittently applying washing liquid to a circle or a spiral line on the inside of the cylinder or spiralinder (preferably at the narrower end if it is tapered) and means for collecting separately fractions of different mobilities axially along the cylinder. The spiral may be one-start or multi-start. The cylinder may be parallel-sided (i.e. a right cylinder) or tapered by a curved or a frustum. "Cylinder" hereinafter includes spiralinder unless the context otherwise requires.

The invention also provides a method of separating minerals, comprising applying a batch of slurry containing the mineral to a circle (or a spiral line) on the inside of a cylinder which may be tapered (or spiralinder) rotating to apply a centrifugal force exceeding g, perturbing the rotating cylinder, arranging the cylinder or spiralinder to have a force acting axially along it such as by a hydrodynamic pressure gradient or by tapering the cylinder, the slurry preferably in the latter case being applied away from the wider end e.g. at the narrower end, applying a batch of washing liquid to the cylinder intersecting the slurry route on the cylinder, and collecting separately slurry fractions according to their different mobilities axially along the cylinder.

The separate collections may be from axially different locations down the cylinder, or of different time fractions reaching a given point (usually at the wider end) of the cylinder.

The perturbations may take any one or more of several forms, for example momentary interruptions to, or accelerations and decelerations superimposed on, the rotation, i.e. circumferential, or shaking to and fro along an axis (such as the axis of rotation) or an orbital motion (possibly in the plane normal to the axis of rotation) so as to keep at least some of the particles mobile.

If the cylinder is tapered, the half-angle of the frustum is preferably up to 45°, such as 1° to 10°. The speed of rotation of the frustum is preferably such as to apply a centrifugal force of from 5 g to 500 g to the table surface, The rotation axis can be vertical, horizontal or at any angle, such as at least 10° from the horizontal. The axial force may be a hydrodynamic pressure gradient or centrifugally induced by tapering the cylinder or by tilting the cylinder.

In all cases, washing liquid is preferably applied intermittently to the cylinder/tapered cylinder/spiralinder flowing over banked heavy material deposited from the slurry. The washing liquid is for assisting removal of material either by virtue of the pressure of the liquid, or for the purpose of improving the grade or cleanness of the heavy mineral in the radially outer layers, when the applied centrifugal force is reduced and/or the shearing action caused by the shaking is increased.

The material may all be kept moving, the slurry application and the washing liquid and the separate collection of high specific gravity and low specific gravity materials being phased to correspond to the differential speeds of these materials. Alternatively, the rotation conditions may be such that the higher specific gravity material is centrifugally pinned down relatively immobile as the lower specific gravity material departs from it, permitting their collection from separate locations.

The collection of material may be batchwise or continuous. If batchwise, the cylinder may slow or cease to rotate, and the cylinder is optionally tilted (unnecessary if the rotation axis was vertical), thus allowing the separated materials (slurry fractions) to fall off separately under gravity or to be removed mechanically (e.g. scraped off by blades mounted to remove fractions selectively) or to be washed off by liquid. If collection is uninterrupted, separated materials may be collected from separate locations, optionally with assistance by washing liquid, by blades each extending axially from the wider end of the cylinder to a respective desired location. The blades in such a version may be replaced by equivalent means, such as jets or curtains of liquid.

In another preferred version, the invention is a mineral separator comprising a hollow cylinder or spiralinder rotatable about its axis, which is vertical. The minerals separator has means for batchwise applying a slurry of the mineral to be separated to the top edge of the cylinder or spiralinder. The cylinder or spiralinder has means for perturbing it sufficiently to keep at least some of the slurry in suspension.

The invention in another preferred version is also separating minerals by applying a slurry of them to the top edge of a hollow spinning vertical-axis cylinder or spiralinder. The cylinder or spiralinder is perturbed enough to keep at least some of the slurry in suspension, and washing liquid is preferably intermittently applied to it and preferably the rotation speed is reduced and/or the frequency and/or amplitude of perturbation are increased. The heavy fraction of the slurry is collected by first removing the light fraction and (a) under gravity, optionally assisted by flushing liquid, or (b) mechanically, collecting the heavy fraction. Where the cylinder/spiralinder is tapered, it would be mounted with its wider end downwards.

The means for rotating the cylinder may be a motor-driven shaft, on which a plurality of the cylinders/spiralinders may be mounted, for example nested outwardly from the same point on the shaft, or spaced axially along the shaft, or both. Ancillary apparatus (such as the slurry feed means) is duplicated appropriately. Material to be treated may be arranged to travel through the plurality of cylinders in series or in parallel or partly both.

There may be a plurality of shafts each with one or more cylinders/spiralinders, with the slurry feed means and the washing liquid feed means arranged to feed to each shaft in sequence.

The invention will now be described by way of example with reference to the accompanying drawings, in which FIG. 1 is a schematic view of a minerals separator according to the invention.

Figure 2:
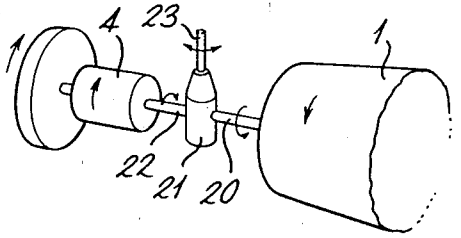
Figure 3:
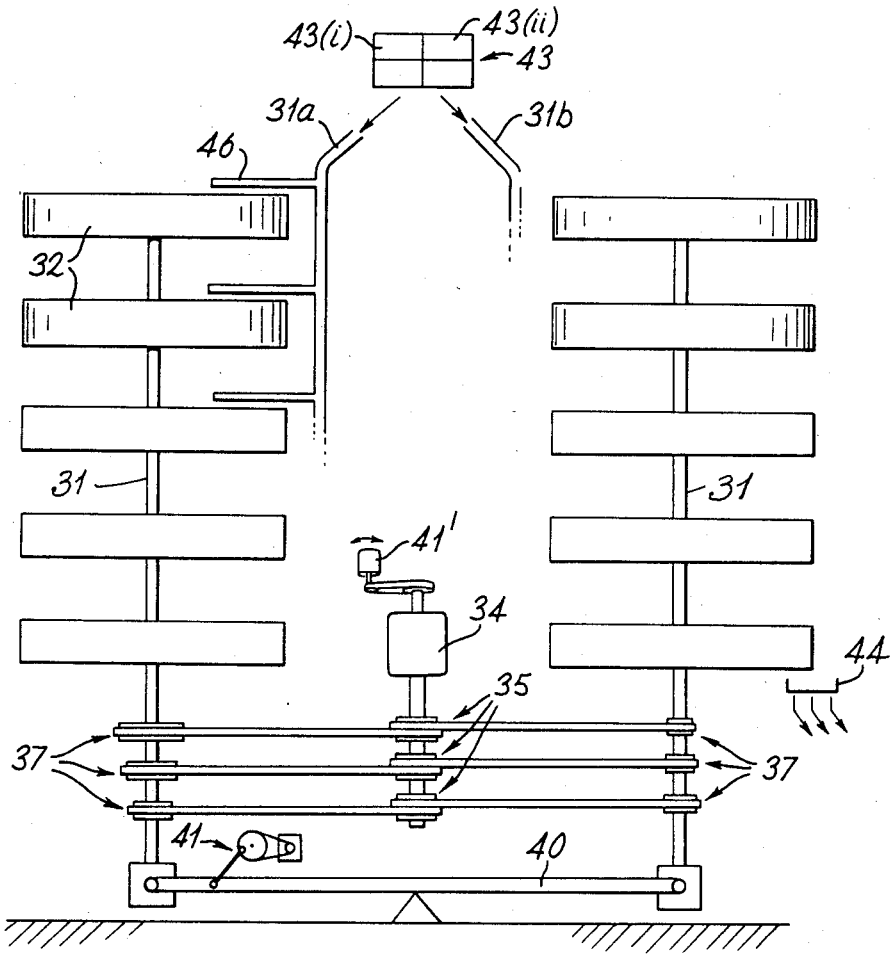
Figure 4:
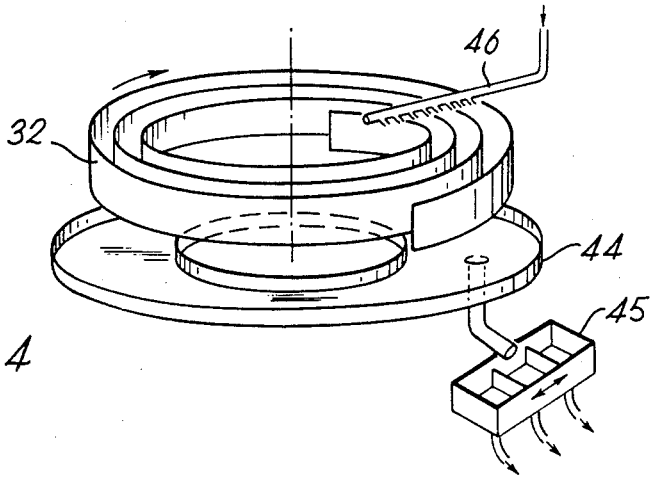

FIG. 2 is a schematic view of part of a minerals separator according to the invention, with an alternative drive system, and FIG. 3 shows a minerals separator according to another preferred version of the invention, and FIG. 4 shows a detail of the minerals separator according to FIG. 3.

In FIG. 1, a minerals separator has a hollow body 1, shown as if transparent, whose inside surface is a frustum. The body 1 is open at its wider end and mounted axially at its narrower end on a shaft 2. The shaft 2 is reciprocated at 7 Hz, amplitude 1½ cm each side of rest, by a shaker 3 and rotated at 400 rpm by a motor 4. The body 1 has a frustum cone half-angle of 1°, an axial length of 30 cm and an average internal diameter of 30 cm. Larger cone angles are effective at higher rotational speeds.

Protruding into the body 1 through its open wider end is a stationary assembly 10 of feed pipes and scraper brushes. The assembly 10 is fed by pipes 12 with slurry and wash water. The slurry in this example comprises ground ore containing small amounts of valuable (high specific gravity) material, the remainder (low specific gravity material) being waste, with all particles finer than 75 microns, half finer than 25 microns and quarter finer than 10 microns, this ground ore being suspended at a concentration of 50 to 300 g, e.g. 150 g, per liter of water. The solids feed rate is kept at about 50 to 300 g/min, whatever the concentration of solids in the slurry. The slurry is fed at 1l/min to the narrower end of the hollow body 1 through a slurry feed pipe 16, and the wash water is fed through a pipe 15 slightly to the rear. Instead of a single feed pipe 16, slurry can be fed over an arc of up to say 180° of the body. The wash water can likewise be fed over an arc. On the other side of the pipe 16 from the pipe 15 is a long generally axial scraper brush 20, which can remove matter from the whole of the inside surface of the body 1 to a collector schematically shown at 21. Between the brush 20 and the pipe 15, opposite the pipe 16, is a similar brush 24 but slightly shorter towards the narrower end of the hollow body 1. The pipes 15 and 16 and the brushes 20 and 24 are all part of the assembly 10. The shorter brush 24 can remove matter from the area which it sweeps, into a collector 25. The brushes 20 and 24 are suitably 90° apart (though illustrated closer, for clarity). The collectors 21 and 25 are adapted to collect (separately, from the brushes 20 and 24) material collected centrifugally from the body 1.

In use, slurry is fed through the pipe 16 to the narrower end of the axially-shaking fast-rotating body 1. The slurry thus is shaken (by the shaker 3) while subject to several g of centrifugal force and separates into components of which the lightest move the most rapidly towards the wider end of the body 1. Increasing the shake speed had the effect of making even the denser particles more mobile.

After about 2 minutes, a given element of slurry fed from the pipe 16 will be enhanced-gravity shaken and separated into density bands down the body 1, and the brush 24 will engage all but the heaviest components of that element of slurry. The brush 24 (aided by wash water from the pipe 15 and from other pipes, not shown, nearer each brush) will remove everything it contacts, into the collector 25. About half a minute later, the heaviest component (i.e. the highest-density band, containing the metal values in all typical cases) is met by the longer brush 20 and washed off into the collector 21 for further treatment. The body 1, now brushed clean, then receives more slurry from the pipe 16, and the described process carries on repeated indefinitely. In a modification, the brushes 20 and 24 could be retractable radially inwardly, and they (or water jets or similar means) would be engaged with the drum only after the materials had been substantially separated, to remove only the most immobile materials, before repeating the cycle by retracting the brushes (or disconnecting the water jets) and applying a further batch of slurry. An example of a sequence of operations, including more detail about the washing phase, is shown in the table which follows later.

The separately collected bands of slurry may be further separated in similar or identical separators. For this purpose, or for separating parallel streams of slurry, or for both purposes, the similar or identical separators may be mounted on the same shaft, spaced axially, or nested radially outwards, or staggered (nested and slightly axially offset), or any combination of these.

FIG. 2 shows a drive system for the minerals separator, providing an alternative to shaking the shaft 2 of FIG. 1; a different perturbation is applied to the body 1 but the separation proceeds otherwise identically as described in relation to FIG. 1. In FIG. 2, the body 1 is mounted on a half-shaft 20 of an automotive-type differential unit 21. The other half-shaft 22 is powered by the motor 4, which is assisted by a flywheel. The 'propeller shaft' 23 is a shaft which is oscillated. The oscillations add accelerations and decelerations to the rotation supplied via the half-shaft 22 and reversed by the differential unit 21, in other words the body 1 may be regarded as rotating steadily with superimposed circumferential oscillations.

FIG. 3 shows a minerals separator according to the invention, with two vertical shafts 31 each carrying five axially spaced right-cylindrical (parallel-sided) spiralinders 32. A common motor 34 has various pulleys 35 giving different speed ratios, via belt drives, to electromagnetic clutches 37 on each shaft. No more than one clutch 37 can be engaged at a time on any one shaft 31.

The shafts 31 are balanced on a pivoted beam 40 which is rocked by a shaker 41 to give axial reciprocations to the shafts and the spiralinders 32 mounted on them. Alternatively (or additionally) an oscillator 41' is connected to the drive from the motor 34 so as to apply angular acceleration and deceleration to the shafts 31 and thus to the spiralinders 32.

A distributor box 43 receives separate supplies 43(i) of a slurry of an ore in water (as described for FIGS. 1 and 2) and 43(ii) of washing water. There are respectively switched sequentially between manifolds 31*a* and 31*b* which feed the spiralinders 32 on each respective shaft 31, as will be shown more clearly in FIG. 4. Collecting troughs 44, also shown more clearly in FIG. 4, are arranged to collect separately the slurry fractions traditionally designated "Concentrate", "Middlings" (for recycling) and "Tailings" (for dumping).

FIG. 4 shows in greater detail one of the spiralinders 32 of FIG. 3. The spiralinder is a stainless steel strip 20 cm high and 40 m long, coiled into a spiral 1½ m in diameter, with consecutive turns held ½cm apart by spars and stays (not shown) which themselves rigidly fix the spiralinder to the axial shaft 31 (not shown). The drawing shows a spiral of only three turns, for clarity, when there are in fact about twelve turns. The spiralinder is rotated in use in the direction shown (rigidly driven by the shaft) at one of various preselected speeds from 30 rpm to 300 rpm. Slurry from the manifold (FIG. 3) reaches a fixed distributor 46 which sprays it onto the top edge inner surface of this spiralinder. With the rotation of the spiralinder, the whole top edge is supplied. on the inside as the collecting surface.

By the same physical processes which sort material as described in FIG. 1, the lightweight fraction traverses the height of the spiralinder first and drips into a trough 44 and thence, is dumped via an appropriately switchd selector box 45. Next the "middlings" report to the trough 44 and switched box 45 and are returned to 43(i). Now the distributor box 43 is switched over to supply washing water from 43(ii) via the manifold to the distributor 46. (Meanwhile, slurry is going to the spiralinders on the other shaft 31). The rotation of the present shaft is slowed, and, under the washing action of the water, the concentrate is washed into the trough 44 and thence into the selector box 45, which is now switched to collect this fraction.

This spiralinder is fed with slurry (10% solids) at the rate of 0.6 liter/min/meter of top edge, for 10–30 say 20 seconds. It is rotated at up to 270 rpm with 200–260 superimposed circumferential shakes per minute of amplitude 8 cm. The shaking is unchanged throughout all the stages described. Then a first wash is performed using water at the same rate as above but for 5–15 say 10 seconds with the rotation reduced to 150 rpm. There follows a second wash, water being applied as in the first wash but the rotation being further reduced to 100 rpm. There follows a third wash, all conditions as before but rotation is 80 rpm. Finally, concentrate is scoured off at 30 rpm with water at twice the foregonig rate, for 10 seconds.

In another example, a ½m diameter parallel-sided spiralinder was run with its axis inclined at 20° to the horizontal. Axial shake at 400 cycles/minute, amplitude 2 cm, is applied throughout. This was rotated at 225 rpm while being fed with slurry (10% solids) for 10 seconds at the rate of 0.1 liter/minute/meter of top edge. Then the rotation is slowed to 200 rpm while first washing water is applied for 10 seconds at 0.6 liter/minute/meter of top edge, then slowed to 150 rpm for a second wash identical otherwise to the first wash, then slowed to 100 rpm for an otherwise identical third wash, then scoured off with more water at fewer rpm.

| Time Elapsed (arbitrary units) | Feed | Low SG Material | High SG Material | Product Issuing out of frustom |
|---|---|---|---|---|
| 0 | Slurry | — | — | — |
| 10 | Slurry | has raced over whole axial length of frustum | concentrated near top of frustum | low SG Material - discarded |
| 20–40 | Slurry | has raced over whole axial length of frustum | moving slowly down frustum | low SG Material - discarded |
| 50 | Slurry | has raced over whole axial length of frustrum | first high SG Material just reaching lower edge of frustum | low SG Material - discarded |
| 60 | Water | last low SG Material is moving rapidly down frustum | first high SG Material passes lower edge of frustum | Mixed - recycled to slurry store |
| 70 | Water | last low SG Material half-way down frustum | High SG material continues to move slowly down frustum | Mixed - recycled to slurry store |
| 80 | Water | last low SG material reaches lower edge of frustum | High SG material continues to move slowly down frustum | Mixed - recycled to slurry store |
| 90–110 | Water (optionally with increased or pulsed feed) | none left | High SG material continues to move slowly down frustum | Clean high SG material - collected |
| 120: repeat from 0 | | — | Last high SG material reaches lower edge of frustum | Clean high SG material - collected |

I claim:

1. A minerals separator comprising a body having a surface having the form of the inside of a spiralinder, which may be tapered, arranged when rotating about a vertical axis to have a force acting axially along it, means for rotating the body about the axis of the spiralinder to apply a centrifugal force exceeding g to said surface, means for applying perturbations to the body, means for batchwise applying a slurry and means for batchwise applying washing liquid to a spiral line on the inside of the spiralinder, and means for collecting separately fractions of different mobilities axially along the spiralinder.

2. A minerals separator according to claim 1, wherein the means for rotating the body is a plurality of driven shafts each with one or more spiralinders, the slurry-applying means and the washing-liquid-applying means being arranged to feed to each shaft in sequence.

3. A method of separating minerals, comprising applying a batch of slurry containing the mineral to a region on the inside of a spiralinder which may be tapered which is rotating to apply a centrifugal force exceeding g, perturbing the rotating spiralinder, arranging the spiralinder to have a force acting axially along it, then applying a batch of washing liquid to the spiralinder, reducing the centrifugal force and/or increasing the perturbing when the washing liquid is applied, optionally more then once, and collecting separately slurry fractions according to their different mobilities axially along the spiralinder.

4. A method according to claim 3, wherein the slurry's component materials are all kept moving, the slurry application and the washing liquid and the separate collection of high specific-gravity and low specific gravity materials being phased to correspond to the differential speeds of these materials.

5. A method according to claim 3, wherein collection of separated materials is batchwise and is achieved in that the spiralinder slows or ceases to rotate, and the spiralinder is optionally tilted (unnecessary if the rotation axis was vertical), thus allowing the separated materials (slurry fractions) to fall off separately under gravity or to be removed mechanically or to be washed off by liquid.

6. A method according to claim 3, wherein the axis is vertical and the slurry is applied towards the upper edge of the spiralinder.

* * * * *